US006732720B2

(12) United States Patent
Kelemencky

(10) Patent No.: US 6,732,720 B2
(45) Date of Patent: May 11, 2004

(54) ULTRASONIC LIQUID FUEL INTRODUCTION SYSTEM

(76) Inventor: Monroe R. Kelemencky, P.O. Box 5008, Woodbury, CT (US) 06798

( * ) Notice: Subject to any disclaimer, the term of this patent is extended or adjusted under 35 U.S.C. 154(b) by 0 days.

(21) Appl. No.: 10/446,962

(22) Filed: May 29, 2003

(65) Prior Publication Data

US 2003/0221678 A1 Dec. 4, 2003

Related U.S. Application Data

(60) Provisional application No. 60/383,808, filed on May 30, 2002.

(51) Int. Cl.[7] ..... F02M 29/00

(52) U.S. Cl. ..... 123/536; 123/538

(58) Field of Search ..... 123/536, 537, 123/538

(56) References Cited

U.S. PATENT DOCUMENTS

| | | | | |
|---|---|---|---|---|
| 2,908,443 | A | | 10/1959 | Fruengel |
| 3,533,606 | A | | 10/1970 | Thatcher |
| 3,646,413 | A | | 2/1972 | Oomen |
| 3,857,375 | A | | 12/1974 | Jackson |
| 3,860,173 | A | | 1/1975 | Sata |
| 3,955,545 | A | | 5/1976 | Priegel |
| 4,100,442 | A | | 7/1978 | Besocke |
| 4,106,459 | A | | 8/1978 | Asai et al. |
| 4,227,402 | A | | 10/1980 | Dooley et al. |
| 4,237,836 | A | * | 12/1980 | Tanasawa et al. ..... 123/537 |
| 4,266,427 | A | | 5/1981 | Wesley |
| 4,338,905 | A | * | 7/1982 | Urich ..... 123/536 |
| 4,344,404 | A | * | 8/1982 | Child et al. ..... 123/538 |
| 4,401,089 | A | | 8/1983 | Csaszar et al. |
| 4,524,748 | A | | 6/1985 | Giannotti |
| 4,570,597 | A | | 2/1986 | Snaper |
| 4,594,969 | A | * | 6/1986 | Przybyiski ..... 123/536 |
| 4,645,965 | A | | 2/1987 | Paganelli |
| 4,767,960 | A | | 8/1988 | Strobel |
| 4,898,024 | A | | 2/1990 | Takeuchi |
| 5,101,659 | A | | 4/1992 | Takeuchi |
| 5,140,966 | A | | 8/1992 | Wong |
| 5,179,923 | A | | 1/1993 | Tsurutani et al. |
| 5,330,100 | A | | 7/1994 | Malinowski |
| 5,380,014 | A | | 1/1995 | Schäperkötter |

FOREIGN PATENT DOCUMENTS

| | | |
|---|---|---|
| EP | 58343 | 8/1982 |
| GB | 508582 | 7/1939 |
| GB | 1138536 | 1/1969 |
| JP | 56-75949 | 6/1981 |
| JP | 57-153964 | 9/1982 |
| JP | 58-200068 | 11/1983 |

* cited by examiner

*Primary Examiner*—Marguerite McMahon
(74) *Attorney, Agent, or Firm*—Richard C. Litman

(57) ABSTRACT

An ultrasonic device for a liquid fuel introduction system that propagates ultrasonic waves through liquid fuel, improving the combustion efficiency of the liquid fuel. The propagated waves cause a reduction or unification of fuel droplet size by breaking apart larger fuel droplets into a distribution of uniform sized fuel droplets, thereby producing a smoother combustion wavefront in an internal combustion engine. The end result is greater fuel efficiency of the I.C.E. The ultrasonic wave is produced via at least one piezoelectric transducer having first and second electrodes adapted to receive an input signal of predetermined frequency and voltage which produces vibrations within a piezoelectric element for generating ultrasonic waves, respectively. The frequency of the ultrasonic wave is varied and tailored so that the most efficient frequency is matched to the specification of a particular fuel (e.g., gasoline, diesel, etc.).

13 Claims, 6 Drawing Sheets

ULTRASONIC LIQUID FUEL INTRODUCTION SYSTEM

CROSS-REFERENCE TO RELATED APPLICATION

This application claims the benefit of U.S. Provisional Patent Application Serial No. 60/383,808, filed May 30, 2002.

BACKGROUND OF THE INVENTION

1. Field of the Invention

The present invention relates generally to liquid fuel introduction systems. More specifically, the invention is an ultrasonic liquid fuel introduction system which produces ultrasonic waves at select or variable frequencies and voltages for reducing the droplet size of fuel molecules and to minimize gas consumption by improving the air-to-fuel ratio for combustion.

2. Description of Related Art

Numerous liquid fuel introduction system systems have been devised with the application of ultrasonic vibration for intensifying atomization of fuel mixtures. The underlying problem in the conventional ultrasonic liquid fuel introduction systems is the necessity for disposing mechanical elements (i.e. heat exchangers or heating elements, vibrating elements, impact surfaces, etc.) directly within the fluid flow path to effect the intended result. Flow inhibiting mechanical elements have been the major cause for liquid fuel introduction system failure, and/or the limiting factor of effective and efficient performance over the life of the liquid fuel introduction system. Further, access to these elements for repair is nearly impossible and usually requires complete replacement in lieu of rebuilding the respective part. The other limiting factors resulting from disposing the respective elements within the flow path are the effects of flow adhesion (in the form of carbon deposits), dispersion and/or dissolution that directly affect a proper air-to-fuel ratio within a combustion or similar chamber.

Ultrasonic liquid fuel introduction systems suffering these particular problems are described in U.S. and Foreign Patents respectively issued and granted to Fruengel (U.S. Pat. No. 2,908,443), Thatcher (U.S. Pat. No. 3,533,606), Jackson (U.S. Pat. No. 3,857,375), Sata (U.S. Pat. No. 3,860,173), Priegel (U.S. Pat. No. 3,955,545), Asai et al. (U.S. Pat. No. 4,106,459), Csaszar et al. (U.S. Pat. No. 4,401,089), Wong (U.S. Pat. No. 5,140,966), Tsurutani et al. (U.S. Pat. No. 5,179,923), Durr et al. (GB 508,582), Moss (GB 1,138,536), Burkhard et al. (EP 58,343) and Yuuichi (JP 57-153,964).

Other attempts to reduce fuel particle size have included separating and recirculating oversize fuel particles, particularly in spark-ignition engines as described in the U.S. patent issued to Giannotti (U.S. Pat. No. 4,524,748). As described therein, the device utilizes a nested set of venturi channels which separate oversize fuel particles in an air-fuel mixture by recirculating them to the fuel supply system for reinjection and atomization. An array of low loss venturi nozzles with central traps is utilized to inertially separate the oversize particles.

U.S. Pat. No. 4,570,597 issued to Snaper discloses a fluid controlled fuel system that includes a plurality of fluid controls each of which is responsive to a particular engine condition. The fluid controls are disposed in fluid branches to meter fuel flow and are configured in four branches to respond to choke (start), idle, acceleration, and cruise conditions to meter fuel to an ultrasonic atomizing spray. The atomizer includes a transducer coil that wraps around an exterior portion of the fuel injector nozzle along its length to deliver ultrasonic waves at the point of fuel discharge.

U.S. Pat. No. 5,330,100 issued to Malinowski discloses an ultrasonic fuel injector energized by a solenoid coil that causes a sealing shaft to be pulled away from a valve seat, resulting in the release of fuel. A hollow ultrasonic horn actuator assembly has a tapered part and an interior transducer assembly embedded therein. This particular arrangement makes it virtually impossible for a skilled mechanic to access the embedded transducer, in the event of failure.

The utilization of embedded piezoelectric transducers with vibration characteristics can be seen in the U.S. Patents issued to Oomen (U.S. Pat. No. 3,646,413) and Besocke (U.S. Pat. No. 4,100,442), respectively. Other applications include those with disclosures wherein piezoelectric transducers have been used to obtain pressure measurements without ultrasonic signal generation at a select transmission frequency for fuel atomization. These particular features are described in U.S. Patents issued to Wesley (U.S. Pat. No. 4,266,427), Strobel (U.S. Pat. No. 4,767,960), Dooley et al. (U.S. Pat. No. 4,227,402), Paganelli (U.S. Pat. No. 4,645,965), Takeuchi (U.S. Pat. No. 4,898,024), Takeuchi (U.S. Pat. No. 5,101,659) and Schäperkötter (U.S. Pat. No. 5,380,014).

Japanese Patent No. 58-200,068 discloses an ultrasonic liquid fuel introduction system comprising a uniform air-fuel mixture between two oscillators, and having formed therein a valve with expandable slits for dispersing fuel. That is, a fuel pipe is formed between an inner and outer piezoelectric ceramic oscillator for fuel traversal. A second set of inner and outer piezoelectric oscillators is adjoined by an intermediate air pipe for introducing air. The outer oscillator is activated by rectangular pulses that compress fuel towards and through the valve with expandable slits.

Japanese Patent No. 56-75,949 discloses a pedal activated ultrasonic liquid fuel introduction system with simultaneous activation of a mixing element disposed within the fluid flow path of a venturi. An ultrasonic generator is disposed at the base of a gas tank comprising a substantially stagnant fuel in liquid form. Ultrasonic waves are promulgated through the base of the tank to a surface portion open to a venturi. One of the problems with this system is the magnitude of transmitted frequencies require to atomize the stagnant fuel in pure liquid form.

None of the above inventions and patents, taken either singly or in combination, is seen to describe the instant invention as claimed.

SUMMARY OF THE INVENTION

The present invention is an ultrasonic liquid fuel introduction system that generates an ultrasonic wave in injected fuel to reduce fuel droplet size. The system breaks down larger fuel droplets into a distribution of uniformly sized fuel droplets to produce a smoother ignition wavefront in an engine of a vehicle that results in greater fuel efficiency. The resulting combustion of the air-to-fuel mixture within the chamber enables piston movement by a uniformly compressive wavefront.

The ultrasonic wave is produced via at least one piezoelectric transducer. The transducer has first and second electrodes adapted, to receive an input signal of a frequency (predetermined or variable) and voltage that produces vibrations within a combustion chamber, or fuel injection channel, or other fuel distribution channel, respectively. The frequency or range of frequencies of the ultrasonic wave is typically varied and tailored so that the most efficient frequency is matched to the specification of a particular fuel (e.g., gasoline, diesel, etc.).

Accordingly, it is a principal object of the invention to provide an ultrasonic liquid fuel introduction system that directly reduces fuel droplet size as a virtually non-invasive system.

It is another object of the invention to provide an ultrasonic liquid fuel introduction system that minimizes fuel flow disturbances within a fuel chamber.

It is a further object of the invention to provide an ultrasonic liquid fuel introduction system that improves the air-to-fuel ratio for effecting a smooth ignition of fuel introduced to the system.

Still another object of the invention is to provide an ultrasonic liquid fuel introduction system that significantly reduces overall fuel consumption.

It is yet another object of the invention to provide an ultrasonic liquid fuel introduction system that decreases air pollution by reducing the amount of unburned fuel, reducing incomplete combustion by-products released into the atmosphere, and increasing the fuel efficiency of an internal combustion engine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
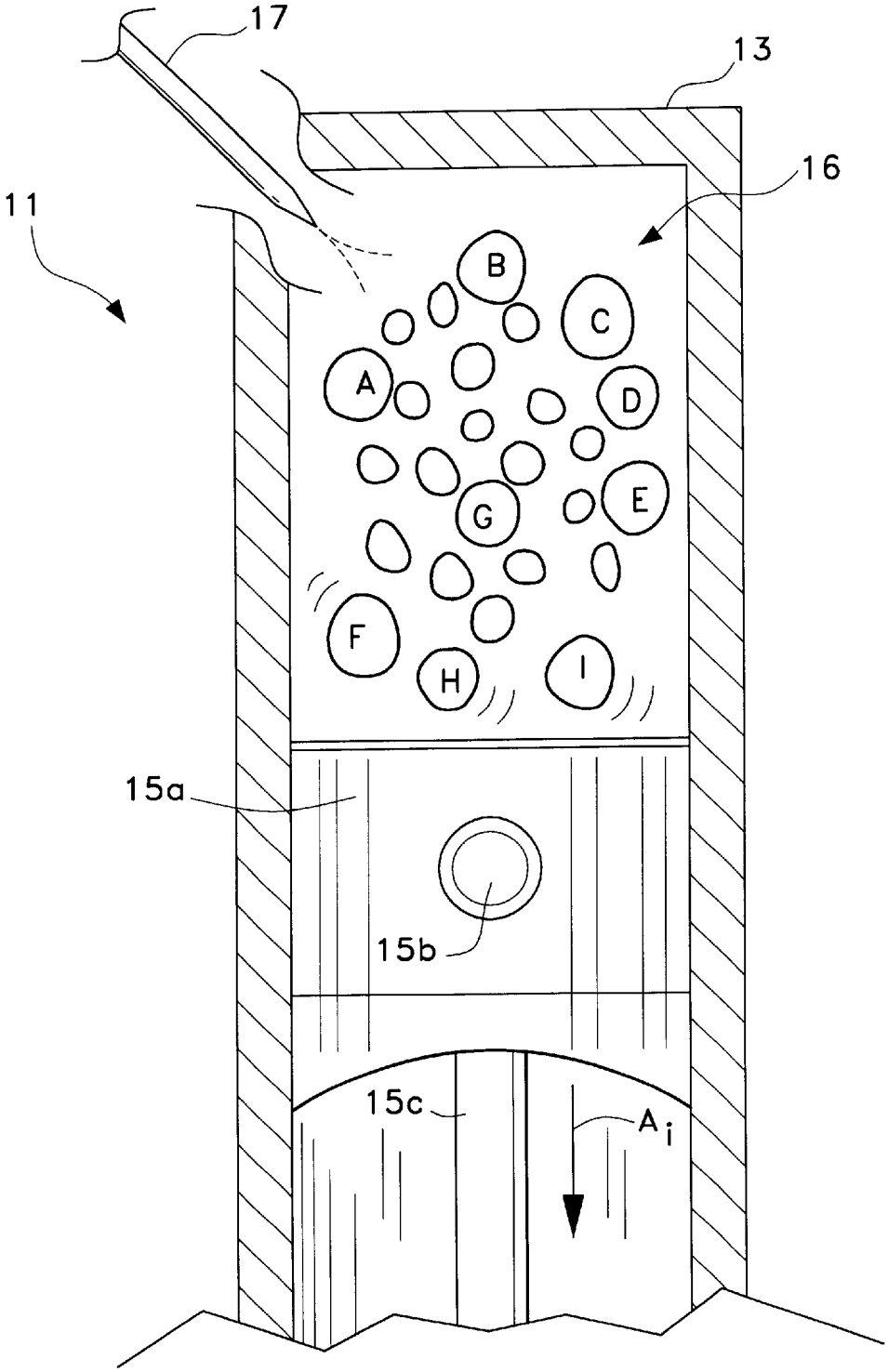
Fig. 1 (Prior Art)
FIG. 1 is a diagrammatic view of a conventional combustion chamber according to the prior art.

The present invention is directed to an ultrasonic system for liquid fuel introduction systems or fuel injectors used in internal combustion engines (I.C.E.'s). The I.C.E. uses a plurality of parts in order to ignite and "burn" fuel to produce mechanical power. The ignition features (spark plug, etc.) are not shown in the drawings in order to facilitate the clear depiction of the essential features of the present invention, conventional ignition elements being well known to one having ordinary skill in the art. In addition, the present invention is applicable to a host of other application areas, such as power plants, treatment facilities and/or fuel furnaces or the like, which require combustible fuel for power generation.

However, to appreciate the uniqueness and understand the effectiveness of the present invention, some basic facts about I.C.E.'s are discussed with respect to FIG. 1. As illustrated in FIG. 1, a conventional internal combustion system 11 is shown. The system includes a combustion chamber 13 configured with a piston 15*a*, rod pin 15*b* and rod 15*c* arrangement. As shown, the fuel mixture 16 has non-uniformly sized fuel droplets. These droplets, varying in size, and substance or composition, are randomly labeled A–I. Droplets A–I are introduced into the chamber 13 (for example, via fuel injector 17 or via a carburetor, not shown) during an intake stroke depicted by arrow $A_i$. Upon ignition of the fuel, due to the non-uniform size distribution of the droplets A–I, a noisy combustion wavefront with variable "noisy" amplitudes or peaks is produced. This phenomenon generally referred to as "cold cranking," produces fuel combustion wavefronts down the chamber 13 as each droplet A–I is ignited throughout the chamber 13.

In this regard, there is associated with each respective droplet A–I a distinct release of energy, which is proportional to the discrete volume of each ignited fuel droplet A–I. The production of the "noisy" or jagged wavefronts is often related to an imbalance in the fuel-to-air ratio, wherein the fuel droplet size is significantly large in volume compared with the volume of air sufficient for effective combustion. Hence, fuel consumption is increased and a "clean" combustion of fuel products is subsequently hindered. The result is the development of residual particles or carbon deposits in the form of surface adhesions within the combustion chamber 13. Such adhesions will generally cause accelerated wear and tear on respective component parts and lead to mechanical failure.

In order to effectively operate an engine with combustible products A–I of a fuel mixture 16 without undue wavefront vibrations or idling during the combustion process in motor vehicles, a uniform consistency of fuel droplets must be achieved having a predetermined magnitude of energy per unit volume, respectively. Upon combustion, the shape of the traveling combustion wavefront produced from the ignited fuel mixture 16 is jagged, thereby representing the different amounts of energy of each droplet A–I. For example, if there is 100% variation in the fuel droplet size or volume of fuel for droplet F having a magnitude of energy of 2.0E (where E represents units of energy) in comparison with fuel droplet D having a magnitude of energy of 1.0E, and wherein the droplet size D represents the optimize size that the piston 15*a* can mechanically react to at an energy magnitude of 1.0E, then the reaction energy between droplet D and droplet F would provide a resultant energy magnitude of 1.0E transmitted as an energy loss.

In other words, the introduction of a fuel mixture 16 comprising 50% of fuel droplets having energies of 1.0E and 50% of the droplets have energies of 2.0E, then 1.0E of the droplet size having an energy of 2.0E is lost in the form of heat or a non-adiabatic combustion process. Thus, it has been found that if all the fuel droplets are of a uniform size having similar energy magnitudes to optimize combustion at the exemplary energy magnitude of 1.0E, then fuel consumption is reduced in volume per introduction 33% and serves to achieve the mechanical advantages for piston motion without jagged or "noisy" combustion wavefronts or vibrations down the chamber 13.

The preferred embodiments of the present invention are depicted in FIGS. 2A–5, and are generally referenced by numerals 6, 6, 7, 8 and 9, respectively.

Accordingly, the ultrasonic liquid fuel introduction system according to the invention is depicted in FIGS. 2A–5. As diagrammatically illustrated in FIGS. 2A and 2B, the ultrasonic liquid fuel introduction system 6 is shown. The system 6 is tuned for two separate fuel mixtures 20 and 22, respectively. As shown FIG. 2A, the system includes a conventional piston arrangement as an exemplary depiction only, wherein a combustion chamber 13 having a fuel of predetermined composition 20 introduced therein is a typical four stroke I.C.E. The chamber 13 is adapted with at least one transducer housing 18 having a first end 18*a* and a second end 18*b*. The first end 18*a* of the housing includes at least first and second apertures 19*a*,19*b* for conveying a plurality of electrical lines 24,25 therethrough. The electrical lines 24,25 are attached to at least one piezoelectric device 26 via first and second electrodes 28 and 29 mounted at the second end 18*b* of the housing 18. The second end 18*b* further comprises external threads for threaded and sealed attachment with a recessed threaded portion 30 formed within an interior portion of the chamber 13.

The piezoelectric devices 26 are fixedly mounted within the housing and receive select signals via electrical lines 24,25 from a function generator 32 which is selectively tuned to a characteristic frequency (or range of frequencies) via control knob 34 and a corresponding voltage via control knob 36 to induce vibrations through the piezoelectric discs 26 with simultaneous production of ultrasonic waves 36 for reducing the non-uniform fuel droplet size from a predetermined fuel mixture (e.g., gasoline fuel 20, FIG. 2A; diesel fuel 22, FIG. 2B; etc.) to a uniform droplet size with a distinct energy magnitude. Accordingly, the fuel mixtures 20,22 may contain fuel conditioning and optimizing agents for enhancing the fuel-to-air ratio or the fuel combustion processes, respectively.

The function generator 32 preferably produces selective multiple input signals in the form of a plurality of different waveforms such as a sinusoidal wave 40, a step wave 42 or saw-tooth wave 44. While these particular waves have been illustrated as exemplary waves used, the function generator is not limited to these particular configurations, but can include input signal waveforms (including superimposed waveforms) of various combinations at select characteristic voltages and frequencies (including resonant frequencies) for reducing fuel droplet size having distinct energy magnitudes. The selective signals 40, 42, 44 respectively transmit vibrations to at least one of the piezoelectric discs 26 via electrodes 28,29 for inducing a characteristic series of ultrasonic wavefronts 36, such that the waves 36 are transmitted within a predetermined path made substantially transverse with a central axis formed along the length of at least one piezoelectric housing 18, thereby reducing the fuel 20 to a stream of regulated uniformed sized fuel droplets.

Also, it should be noted that the size of each piezoelectric device 26 is formed having a critical surface area and thickness to affect a specific wavefront having a fuel specific frequency for reducing fuel droplet size. The vibrations produced by a distinct sized piezoelectric element will have a goal specific effect on reducing the various droplet sizes of each type of fuel to substantially uniform droplet sizes with substantially uniform energy magnitudes. The relationship of vibration frequency is in proportion to the size and thickness of each piezoelectric disc 26 (i.e., the greater dimensioned device 26 the lesser produced vibration, and likewise smaller dimensioned device 26, the larger produced vibration).

Figure 2A:
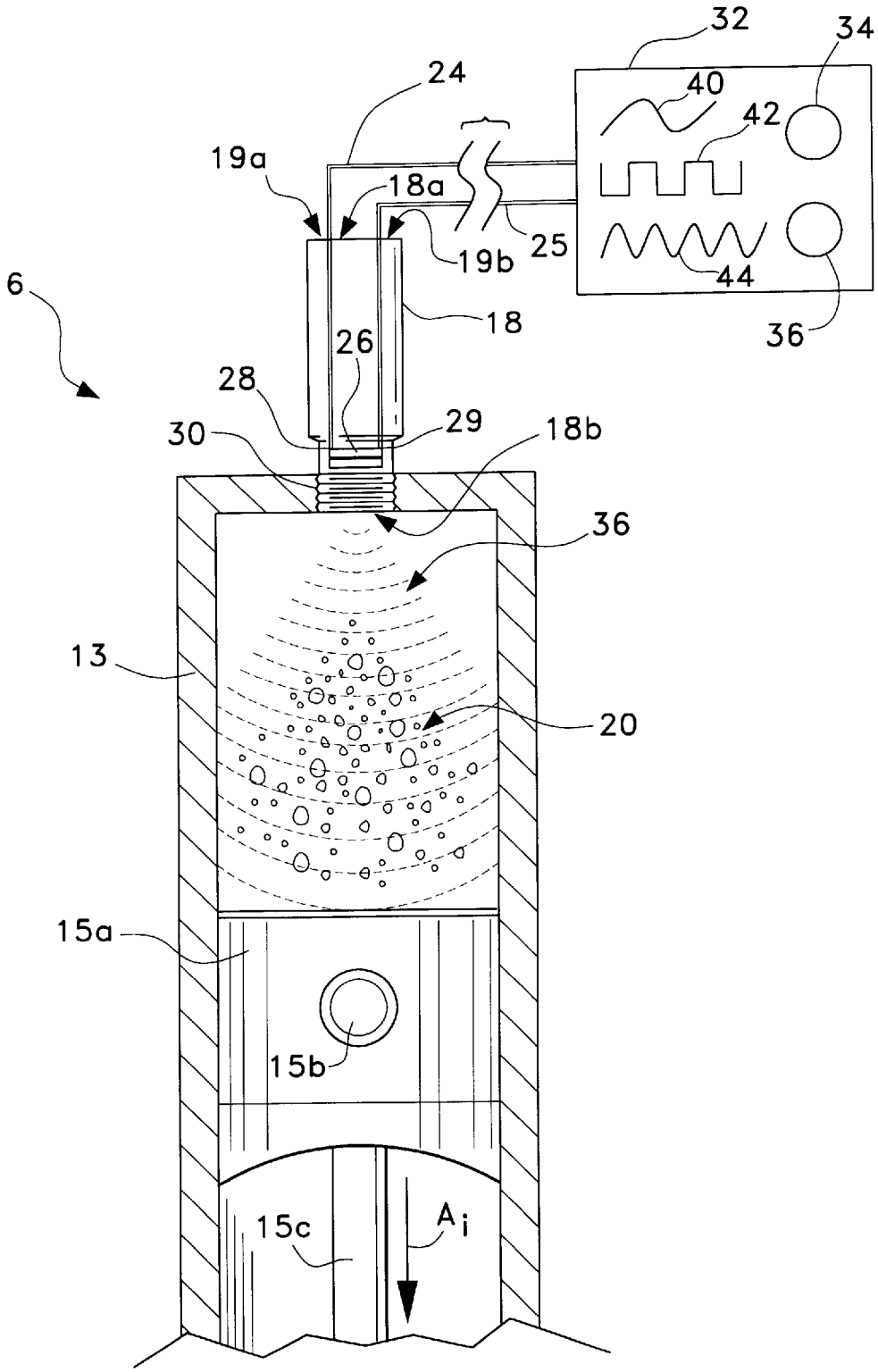
FIG. 2A is a diagrammatic sectional view of a single cylinder combustion chamber for gasoline-based systems according to the present invention.
Figure 2B:
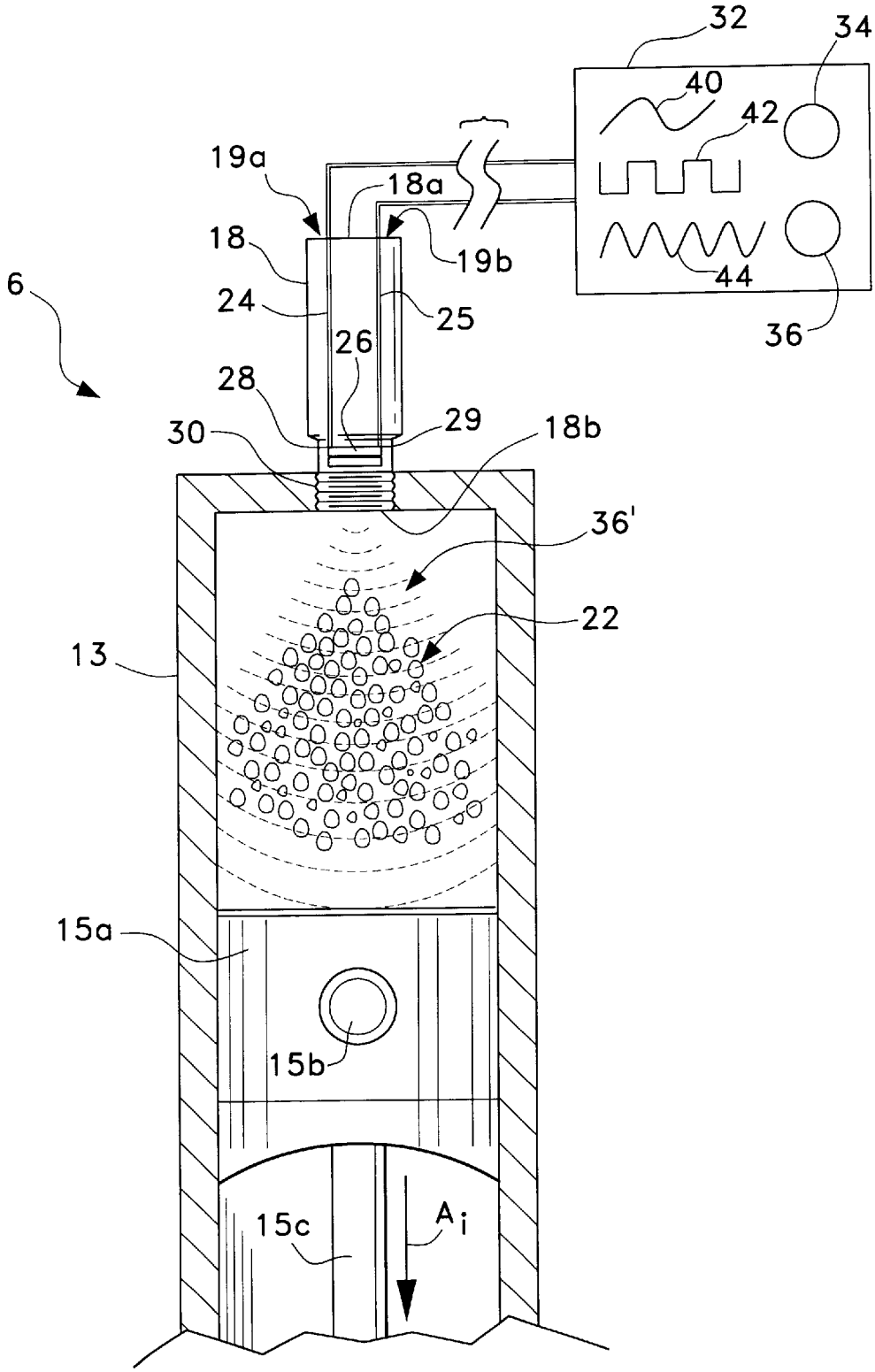
FIG. 2B is a diagrammatic sectional view of a single cylinder combustion chamber for diesel-based systems according to the present invention.

Similarly, a two-stroke I.C.E. is illustrated as alternate embodiment 6 to FIG. 2A is shown in FIG. 2B, except a diesel fuel mixture 22 is shown differing in droplet size. Thus, the excitation frequency of the input signal or subsequent wavefront has been indicated as 36' to denote a different characteristic frequency and voltage required to produce a uniform volume of fuel droplets respectively. In essence, the invention provides the same improvement to a two-stroke I.C.E. of FIG. 2B, as it does to the four-stroke I.C.E. of FIG. 2A.

Figure 3:
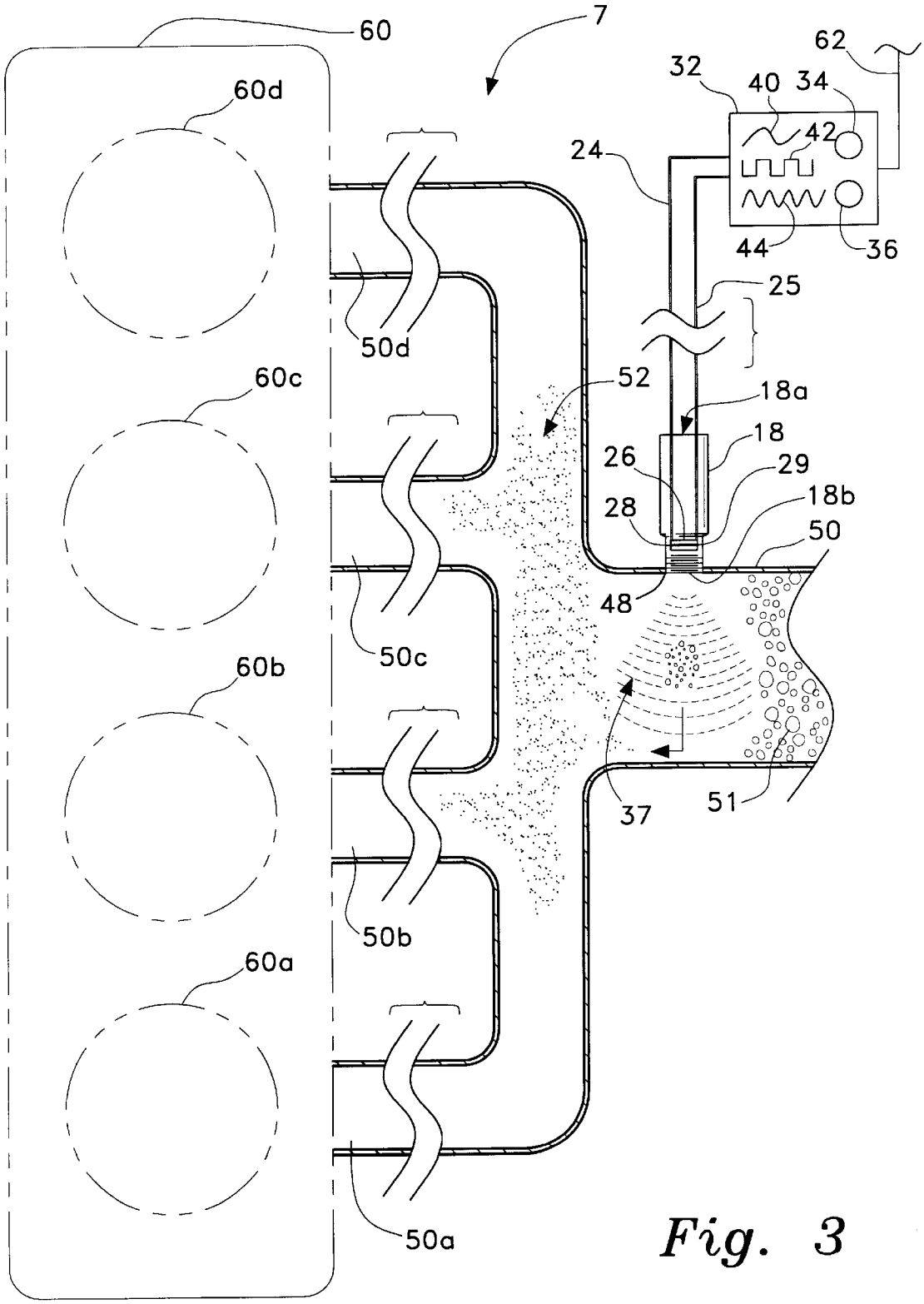
FIG. 3 is a diagrammatic view of an ultrasonic liquid fuel introduction system according to a second embodiment of the invention.
Figure 4:
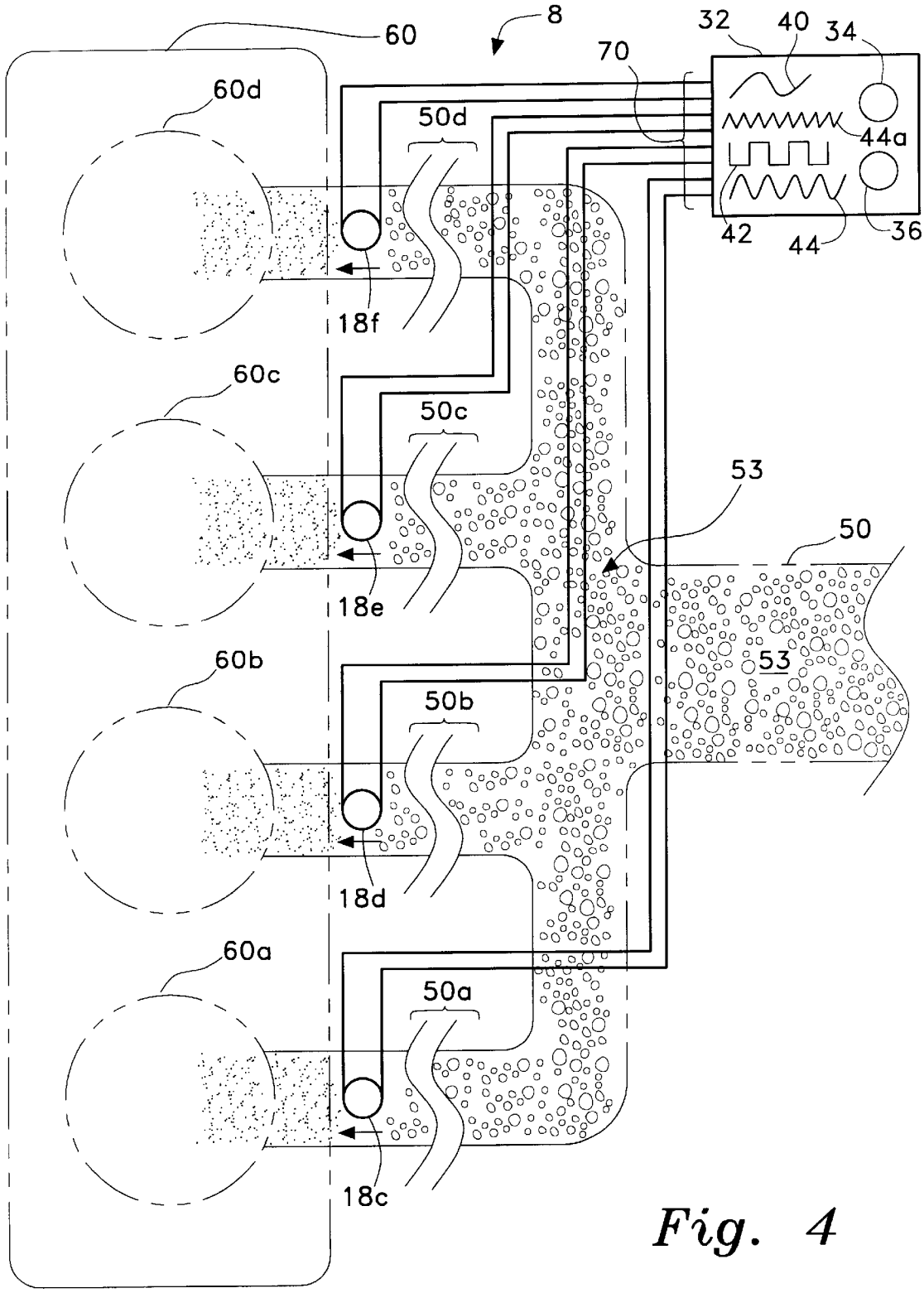
FIG. 4 is a diagrammatic view of an ultrasonic liquid fuel introduction system according to a third embodiment of the invention.

As diagrammatically illustrated in FIGS. 3 and 4, the ultrasonic liquid fuel introduction system 6 is shown according to respective second and third embodiments 7 and 8. As shown in FIG. 3, the ultrasonic liquid fuel introduction system 7 is adapted to a threaded sidewall portion 48 of a single channel 50 before fuel mixture entry 51 within a combustion chamber system 60. The channel 50 is shown having a fuel mixture 51 which flows into a multiple series of sub-channels 50*a*, 50*b*, 50*c*, and 50*d* which are in fluid communication or attachment with chambers 60*a*, 60*b*, 60*c*, and 60*d*, for receiving ultrasonically reduced fuel droplets 52 therein for subsequent ignition and/or combustion. The function generator or input signal source 32 is further illustrated having a power line 62 which can be electrically configured to turn on/off via the ignition switch of a vehicle or to be selectively activated via an auxiliary on/off switch (not shown) having a direct connection to an automobile's on-board Direct Current (DC) or battery source. The subsequent induced ultrasonic wave 37 is similarly tuned to a selective frequency or resonant frequency and voltage corresponding to the specific fuel mixture 51 for reducing its size to uniform droplets of specific energy magnitudes for a "clean" combustion process (i.e., no residual particle accumulation within the chamber).

As diagrammatically illustrated in FIG. 4, the ultrasonic liquid fuel introduction system 8 is shown from a top view according to the third embodiment, wherein the sub-channels 50*a*, 50*b*, 50*c*, and 50*d* of the channel identified in FIG. 3 are configured with a respective series of ultrasonic housings 18*c*, 18*d*, 18*e* and 18*f*, for selectively inducing ultrasonic waves to a fuel mixture 53 at the same or different characteristic voltages and frequencies (in various combinations per respective housing 18*c*, 18*d*, 18*e* and 18*f*) of multiple inputs 70 to reduce the fuel droplet size respectively. In this configuration, multiple signal input signals are generated to perform a specific outcome. Power for the function generator 32 is provided as similarly noted above.

Figure 5:
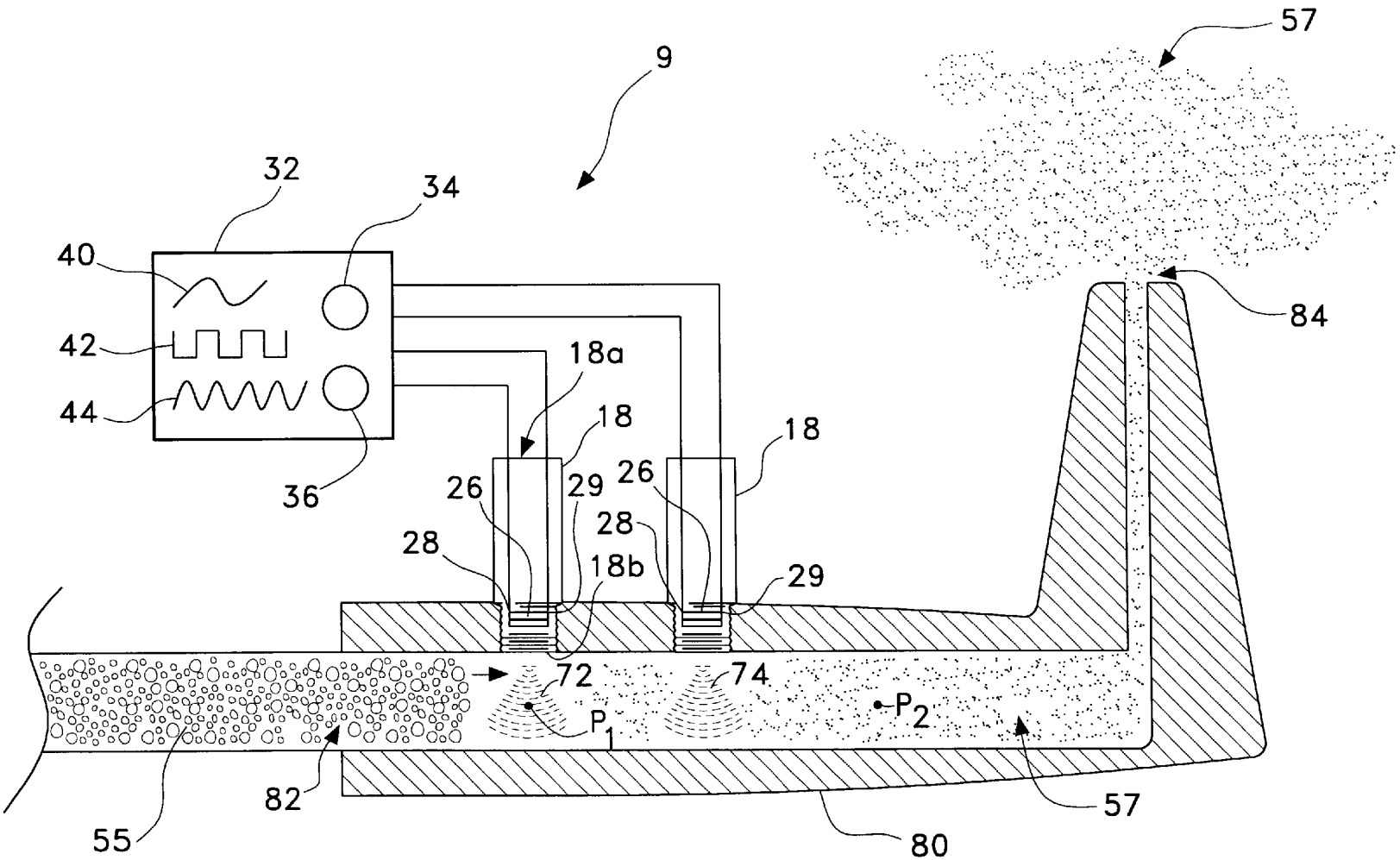
FIG. 5 is a diagrammatic view of an ultrasonic liquid fuel introduction system according to a fourth embodiment of the invention.

According to the fourth embodiment 9, as seen in FIG. 5, a series of ultrasonic housings 18 is shown, each having at least one piezoelectric transducer 26 disposed in a linear arrangement at a spaced interval distance to effect multiple ultrasonic wavefront excitations 72 and 74, respectively to a fuel mixture 55. As shown therein, a fuel mixture 55 enters an introduction nozzle or channel 80 via its influent end 82 and exits via its effluent end 84. Adjacent to the effluent end 82 is disposed a first ultrasonic housing 18 for ultrasonically exciting the fluid mixture according to predetermined voltage and frequency level for reducing fuel droplet size for the fuel mixture 55. Between a point P1 indicating a first ultrasonic excitation and a point P2 measured downstream at least one other ultrasonic hosing 18 is linearly disposed in spaced relation a distance D for refining ultrasonic excitation of the fuel prior to leaving as ultrasonically refined effluent droplet fuel 57 via the effluent end 84 of the introduction nozzle. In a similar fashion, the induced ultrasonic wavefronts 72, 74 can comprise the same or different characteristic frequency and voltage for delivering ultrasonic waves to the respective fuel to reduce fuel droplet size to uniform fuel droplets of similar energy magnitudes for subsequent "clean" combustion. To reduce fluid flow losses and surface roughness within the flow path of a particular chamber used, at least one transducer housing 18 is disposed within the chamber 13, such that the threaded surface end 18*b* of the housing 18 is made perfectly flush with an inner most wall surface portion 13*a* of the respective chamber or fuel flow channel 13. This particular fitting of the housing 18 effects a substantially constant flow of fuel 20,22 from a point P1 of ultrasonic excitation of every fuel droplet to a fuel flow point P2 downstream of the chamber 13 or respective channel (See FIG. 5).

In sum, ultrasonic liquid fuel introduction system according to the instant invention has the primary advantage that it does not require the utilization of intermediate elements such as heat exchangers or heating elements to reduce fuel droplet size as a catalyst which hinder direct in-line fluid flow and contributes to various types of fluid flow losses therein (in the form of obstructions and the source of residual particle adhesions just to name a few). The resultant peaks of the wavefront, after ultrasonic excitation within or before entry of the fuel within a combustion chamber reduces vibrations, thus reducing mechanical wear within the respective chamber.

Also, an important feature, the substantially uniform sized droplets reduce fuel consumption and air pollution due to decreased unburned particles and improperly combusted exhaust gases. In addition, residual particle accumulation is reduced by way of an improved air-to-fuel volume ratio. As such, the excess energy loss from a non-adiabatic process is virtually eliminated. The piezoelectric transducer is preferably of, but not limited to, the ceramic material, or the like type, primarily because it is impervious to high temperatures related to combustion processes. Similarly, construction of the housing may be of, but not limited to, ceramic materials, so long as the material is impervious to failure from high combustion temperatures. Further, certain spark ignition features and fuel injection details have not been shown in any great detail, particularly in FIGS. 2A–4 for the purpose of illuminating the ultrasonic features of the invention. It is expected that one having ordinary skill in the relevant art would know how to make and use the invention and/or to eliminate any other effects related to high combustion processes and the respective elemental parts of the invention to provide combustion chamber temperatures. In this regard, detail features of certain mechanical elements (i.e. spark ignition elements, fuel injection elements, and the like) have not been discussed or shown for sake of clarity in describing the essential features of the invention.

It is to be understood that the present invention is not limited to the sole embodiments described above, but encompasses any and all embodiments within the scope of the following claims.

I claim:

1. A device for converting non-uniformly sized droplets of liquid fuel into substantially uniform droplets of liquid fuel in a combustion system, the device comprising:

a sealed housing;

an electrical excitation source providing at least one electrical excitation signal having at least one frequency and amplitude;

a transducer disposed in the housing and electrically coupled to the electrical excitation source, the transducer receiving the excitation signal and producing a series of ultrasonic wavefronts externally of said sealed housing;

wherein the ultrasonic wavefronts are propagated through the non-uniformly sized droplets of liquid fuel, causing the droplets to break apart, thus resulting in substantially uniform sized droplets.

2. A device according to claim 1, wherein the sealed housing has a threaded end, the threaded end being adapted for seating into a threaded aperture of a structure enclosing fuel such that the threaded end of the housing is proximate to the liquid fuel.

3. A device according to claim 1, wherein the transducer includes at least one piezoelectric device, each piezoelectric device being sized and configured to provide characteristic ultrasonic wavefronts for a respective specified liquid fuel type.

4. A device according to claim 1, wherein the electrical excitation source is a function generator for producing the at least one electrical excitation signal having at least one frequency and amplitude, and wherein the excitation signal has a cyclical characteristic.

5. A device according to claim 4, further including means for electrically connecting the transducer to the electrical excitation source, wherein the means extends through the housing from the transducer to the source.

6. A device for use in a combustion system, the device adapted to convert droplets of liquid fuel having non-uniformed sizes into droplets of liquid fuel having substantially uniform size, the device comprising:

at least one sealed housing;

an electrical excitation source to provide at least one electrical excitation signal having at least one frequency and amplitude;

at least one transducer disposed in each of the at least one housing, each at least transducer being electrically coupled to the electrical excitation source for receiving the excitation signal and producing a series of ultrasonic wavefronts externally of said sealed housing;

wherein the ultrasonic wavefronts propagate through the liquid fuel, causing the non-uniform size droplets to break apart into droplets of substantially uniform size;

whereby an improvement of the combustion of the liquid fuel results.

7. A device according to claim 6, wherein the sealed housing has a threaded end, the threaded end cooperatively seats into a threaded aperture such that the threaded end of the housing is proximate to the liquid fuel.

8. A device according to claim 6, wherein the transducer includes at least one piezoelectric device, each piezoelectric device is sized and configured to provide characteristic ultrasonic wavefronts for a respective specified liquid fuel type.

9. A device according to claim 6, wherein the electrical excitation source is a function generator for producing the at least one electrical excitation signal having at least one frequency and amplitude; whereby the excitation signal has cyclical characteristic.

10. A device according to claim 9, further including means for electrically connecting the transducer to the electrical excitation source, wherein the means extends through the housing from the transducer to the source.

11. A device according to claim 9, further including at least two transducers in each housing, wherein each transducer receives an excitation signal having a respective frequency and amplitude, whereby each the wavefront, generated by each respective transducer, has a characteristic independent of the other generated wavefronts, for breaking apart specific droplets of specific liquid fuel types so as to produce droplets of uniform size irrespective of the fuel types.

12. A device according to claim 6, wherein each housing is made of material impervious to the temperatures of combustion.

13. A device according to claim 12, wherein each sealed housing has a threaded end, the threaded end cooperatively seating into a threaded aperture of an internal combustion engine such that the threaded end of the housing is proximate to the liquid fuel and each of the at least one transducers is secured in the threaded end of the housing.

* * * * *